US005984722A

United States Patent [19]

Ito

[11] Patent Number: 5,984,722

[45] Date of Patent: Nov. 16, 1999

[54] PRINTED BOARD CONNECTOR

[75] Inventor: Masahiro Ito, Ota-ku, Japan

[73] Assignee: Taiko Denki Co., Ltd, Tokyo, Japan

[21] Appl. No.: 09/062,743

[22] Filed: Apr. 20, 1998

[30] Foreign Application Priority Data

Jul. 14, 1997 [JP] Japan ..... 9-203832
Oct. 9, 1997 [JP] Japan ..... 9-009483

[51] Int. Cl.[6] ..... H01R 13/60
[52] U.S. Cl. ..... 439/567; 439/557
[58] Field of Search ..... 439/567, 557

[56] References Cited

U.S. PATENT DOCUMENTS 5,192,228 3/1993 Collins et al. ..... 439/567
5,199,896 4/1993 Mosquera ..... 439/557
5,409,386 4/1995 Banakis et al. ..... 439/567

FOREIGN PATENT DOCUMENTS 8-964938 10/1996 Japan .

*Primary Examiner*—Paula Bradley
*Assistant Examiner*—Katrina Davis
*Attorney, Agent, or Firm*—Oliff & Berridge, PLC

[57] ABSTRACT

There is disclosed a printed board connector whose leg structure has a high strength, is further provided with an appropriately strong spring property and can securely fix a connector to a printed board even if there is a slight dispersion in dimension precision. A pair of right and left leg components are extended from an under end surface of a housing, and spaced apart from each other. Tip-end portions of the leg components are interconnected to form an integral structure of a leg. At least one of the leg components has on its outer side surface a substantially hemispheric projection to be engaged in a fitting hole of the printed board. The leg component also has a V-shaped hollow portion on its inner side surface, with the top portion being positioned on a substantially horizontal center line of the projection.

7 Claims, 9 Drawing Sheets

PRINTED BOARD CONNECTOR

BACKGROUND OF THE INVENTION

1. Field of the Invention

The present invention relates to a printed board connector for making an electrical connection with a printed board.

2. Description of the Related Art

In a conventional fixing structure for fixing a printed board connector to a printed board, as shown in the Japanese Design Registration No. 964938 and particularly the front view of FIG. 15, a pair of right and left leg components 2 and 3 are extended away from and parallel with each other from an under end surface 1A of a connector housing 1 manufactured using resin. Additionally, legs 5 each having a substantially hemispheric projection 4 on an outer side face of the leg component 3 are provided on right and left end portions of the connector housing 1. When the connector is mounted on a printed board P via the two legs 5 of the connector housing 1, the leg components 2 and 3 are pressed into a fitting hole B of the printed board P from tip-end portions thereof. Then, as shown by a dashed line of FIG. 16, mainly the leg component 3 with the projection 4 protruding therefrom is elastically deformed inward by using its base portion 3A as a supporting point. When the projection 4 is passed through the fitting hole B, the leg components 2 and 3 return to a condition shown by a solid line of FIG. 16. Subsequently, a base portion 4A of the projection 4 is engaged with an under peripheral edge of the fitting hole B, thereby fixing the connector.

Then, a plate thickness t of each of the leg components 2 and 3 is usually as thin as 0.4 mm or less. Additionally, tip-end portions of the leg components 2 and 3 are separated from each other. Therefore, the leg 5 is given a soft spring property in a transverse direction. Attachment to or detachment from the fitting hole B is advantageously facilitated.

On the other hand, however, at the time of manufacture of the connector housing 1, multiple connector housings are collected in one place in a mixed condition. Since the tip ends of the leg components 2 and 3 constituting the leg 5 are separated, the legs 5 of the connector housing 1 become entangled with those of another connector housing. As a result, in a preparatory process for supply to an automatic mounting device in which terminals are assembled in the connector housing 1, i.e., in an automatic alignment/supply device, trouble is likely to arise.

Also, with regard to the strength of the leg 5, i.e., the leg components 2 and 3, the base portions 2A and 3A have weak structures. Therefore, during the manufacture of the connector housing 1, the assembly of terminals, the conveyance, the mounting of the connector to the printed board P and the like, the base portions 2A and 3A of the leg components 2 and 3 are easily broken. This increases a ratio of defective products. When the connector is mounted on the printed board P without the breakage or the like of the leg components 2 and 3 being noticed, the leg 5 cannot secure the spring force necessary for holding and fixing the connector. Therefore, in some cases the connector falls off the printed board P.

Further, the leg 5 constituted of the independently separated leg components 2 and 3 has a weak spring property. Therefore, if the connector is mounted with the base portion 4A of the projection 4 not being engaged with the under peripheral edge of the fitting hole B, depending on a dispersion in precision, the connector is lifted above a mounted face of the printed board P when soldering is performed from a rear side of the printed board P. A defect in connection is thus easily caused.

An object of the present invention is to provide a printed board connector whose components are prevented from being entangled or broken, have elastic and rigid structures and can be fixed firmly to a printed board.

SUMMARY OF THE INVENTION

To attain this and other objects, the present invention provides a printed board connector which has plural legs each extending from an under surface of a housing and comprised of a pair of right and left leg components. The leg components have tip-end portions interconnected with each other to form an integral structure. One of the leg components has on its outer side surface a substantially hemispheric projection and on its inner side surface a V-shaped hollow portion whose top portion is positioned on a horizontal center line of the projection. Plural contacts held in the housing are arranged between the legs. The integrally interconnected structure of the leg tip-end portion prevents the components from being entangled. Since the V-shaped hollow portion is additionally provided, the elasticity of the leg is properly increased. The connector is firmly fixed on the printed board.

Opposite to the hollow portion on the inner side surface of the leg component a hollow portion is also formed on an inner side surface of the other leg component. In this case, elasticity of the leg is increased. More secure and stabilized fixing can be realized.

Further, base portions of the pair of right and left leg components are positioned above an under end surface of the housing. In this case, the leg can be easily deformed elastically. Further, stabilized fixing can be attained.

Further, when the contact is a male contact, a portion of a base portion upper end of a contact portion is held in a holding groove which is formed in the housing and which has a projection on one of opposed faces. The entire connector can then be held on the printed board in a stable condition.

BRIEF DESCRIPTION OF THE DRAWINGS

The present invention will be clarified by description with reference to the following drawings.

DESCRIPTION OF THE PREFERRED EMBODIMENTS

Embodiments of the invention will be described in detail based on the accompanying drawings.

Figure 1:
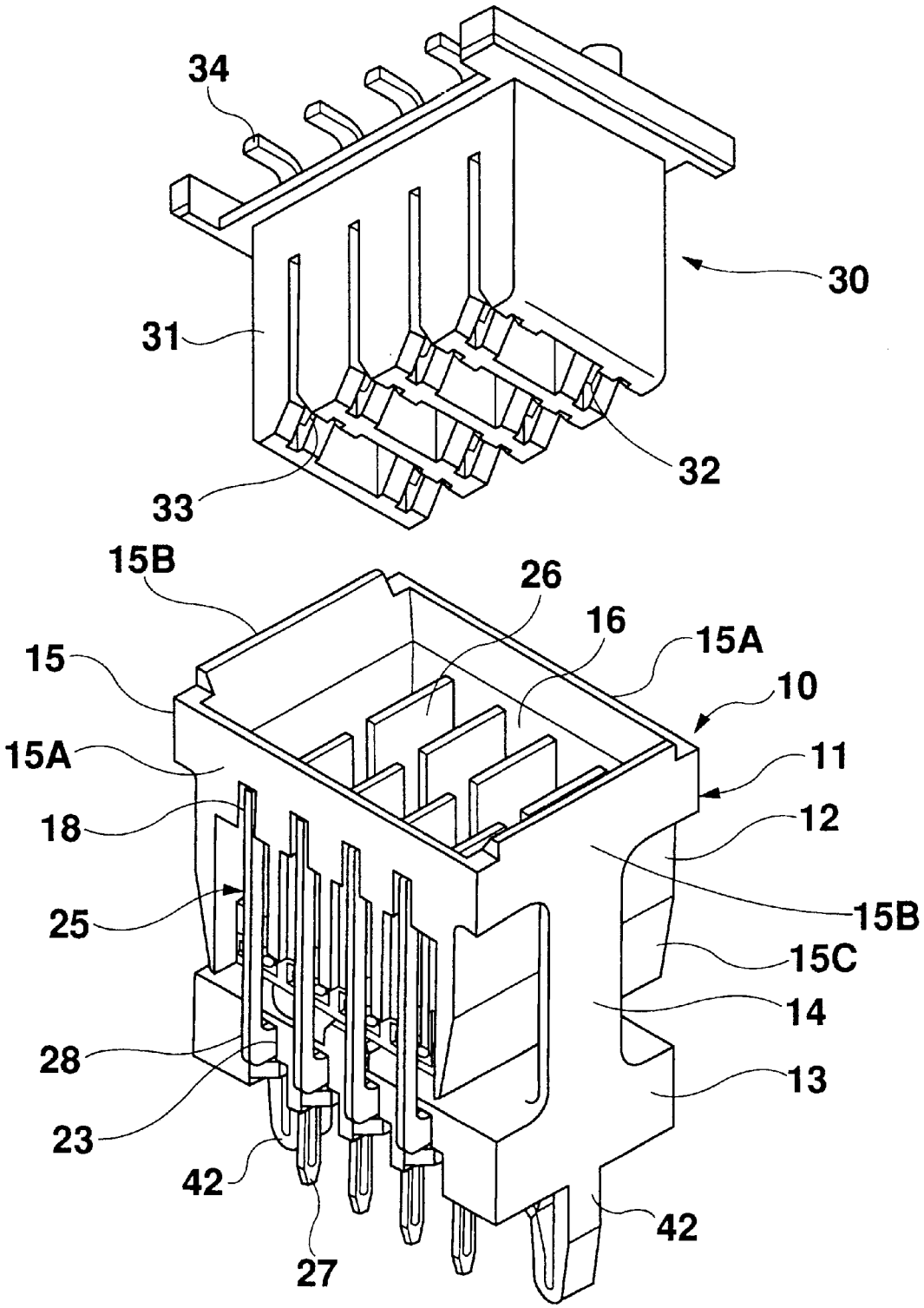
FIG. 1 is a perspective view showing an entire constitution of a printed board connector according to the invention.
Figure 2:
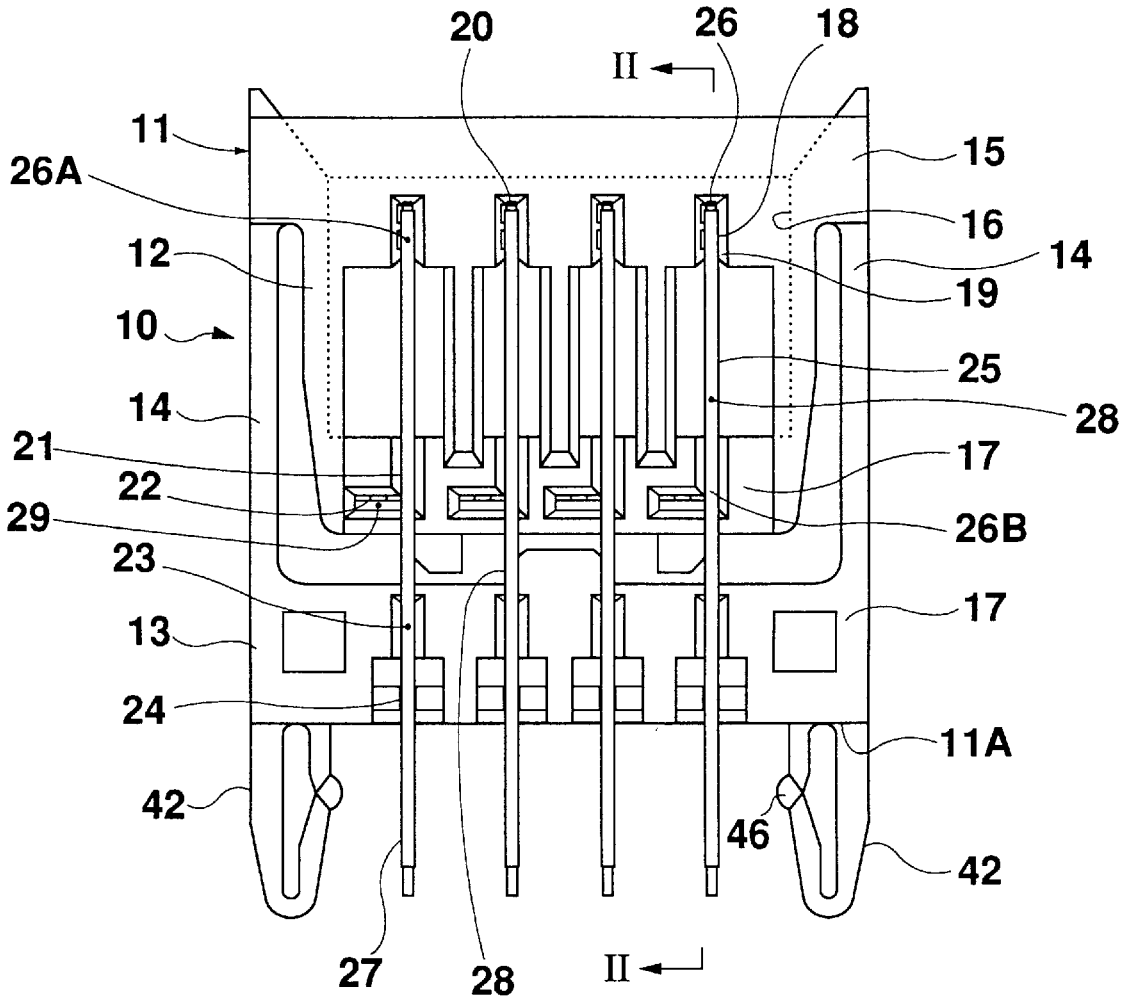
FIG. 2 is an enlarged front view of a male connector of FIG. 1.

In FIGS. 1 and 2, numeral 10 denotes a male connector which has a rectangular parallelepiped housing 11. The housing 11 is comprised of an upper housing 12 and a lower housing 13. The upper and lower housings 12 and 13 are, as shown in FIGS. 1 and 2, fixed to upper and lower ends of connecting portions 14 which are built on opposite sides of the housing 11, and integrally interconnected.

The upper housing 12 is provided with a transversely rectangular side wall rim body 15 which is comprised of front and rear side wall rims 15A along longitudinal sides and right and left side wall rims 15B along short sides. The upper housing 12 is also provided with opposite side walls 15C which are extended from the side wall rims 15B. Inside the side wall rim body 15 an inner space portion 16 is formed which is engaged with a female connector 30 described later. A lower portion of the inner space portion 16 is closed by a bottom plate 17 with a predetermined thickness which is connected to lower end portions of the opposite side walls 15C.

Numeral 18 denotes upper holding grooves which are formed at predetermined intervals in the front and rear side wall rims 15A. The upper holding grooves 18 are extended from substantially center portions to lower ends of the side wall rims 15A, and have plane-off corners 19 on portions which open to the outside. Numeral 21 denotes middle holding grooves which open in an upper face of the bottom plate 17 and are positioned on the same axial lines as those of the upper holding grooves 18. In lower ends of the middle holding groove 21 side holding grooves 22 are formed which are continuous from the middle holding grooves 21.

Numeral 23 denotes lower holding grooves which are formed in the lower housing 13 and on the same axial lines as those of the upper holding grooves 18. Lower ends of the lower holding grooves 23 are connected to vertically extended terminal grooves 24.

Figure 3:
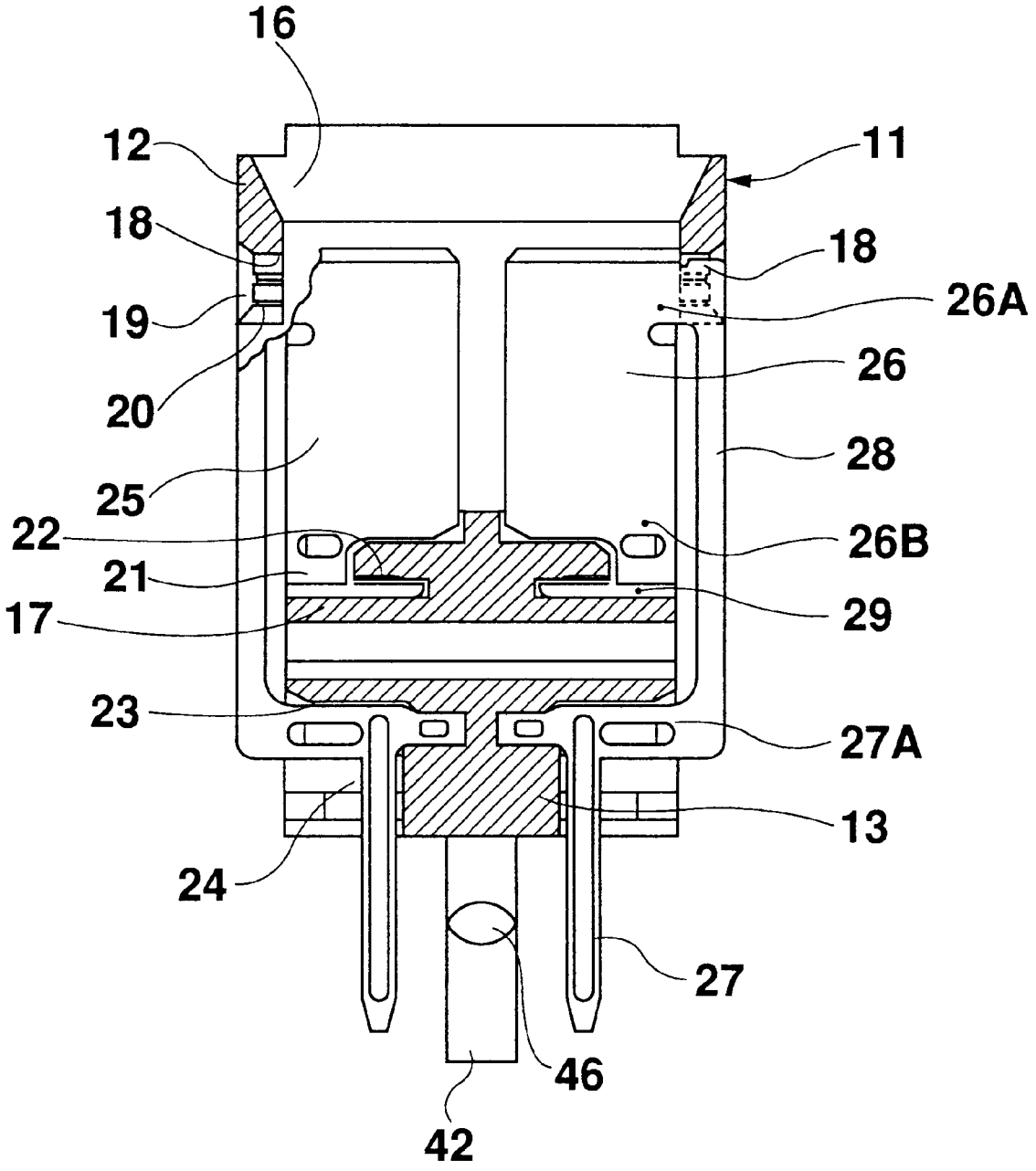
FIG. 3 is a sectional view taken along line II—II of FIG. 2.
Figure 4:
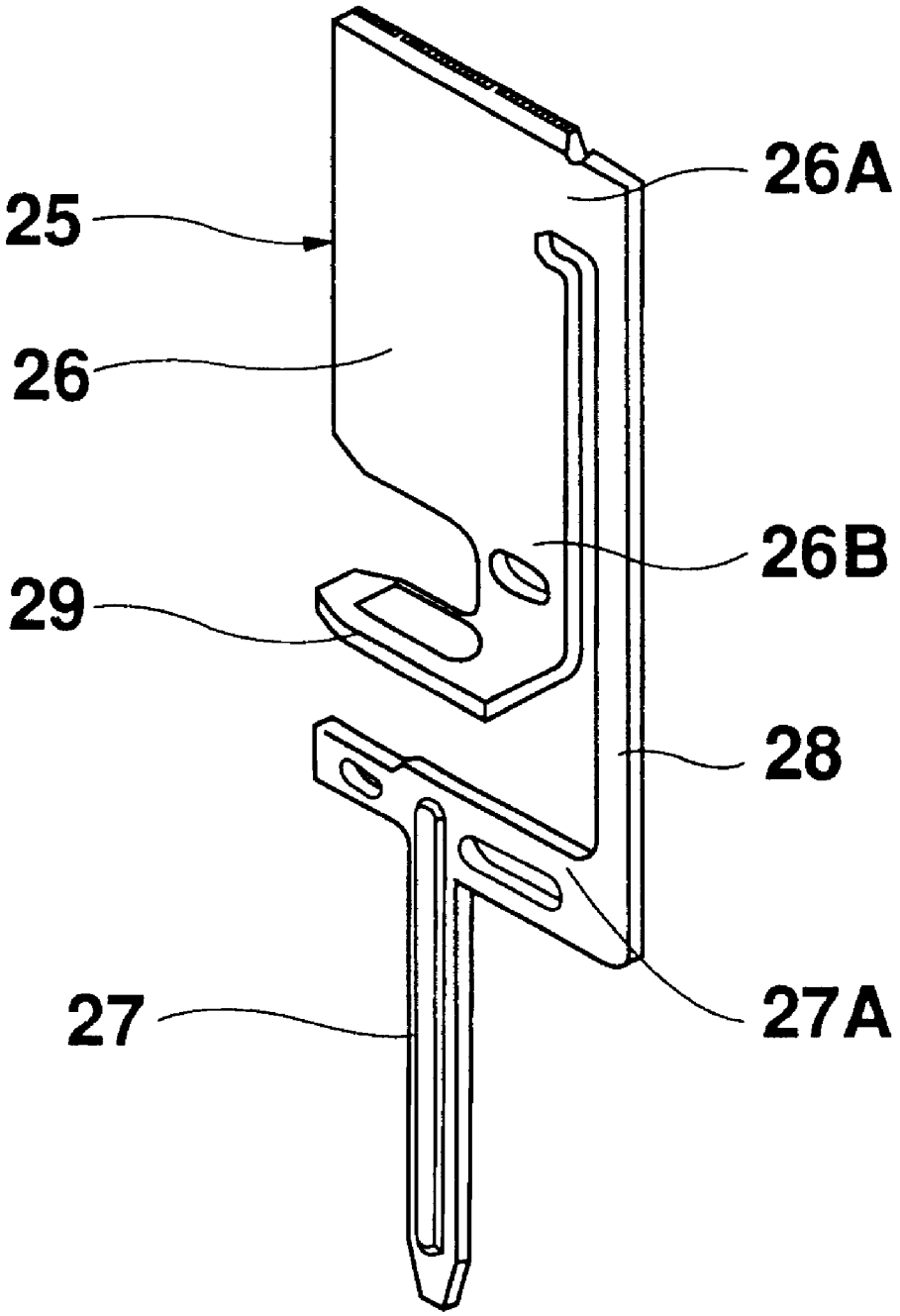
FIG. 4 is a perspective view of a male contact for use in FIG. 2.
Figure 5:
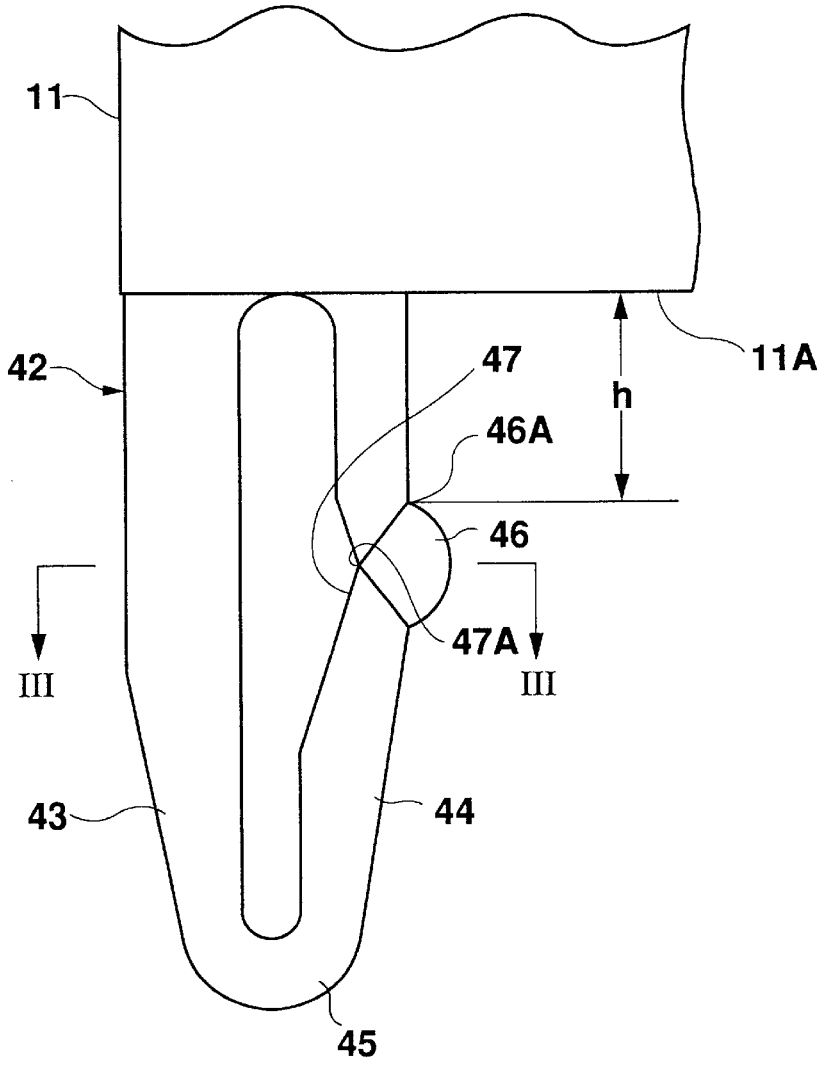
FIG. 5 is an enlarged front view of a leg of a male connector shown in FIG. 2.
Figure 6:
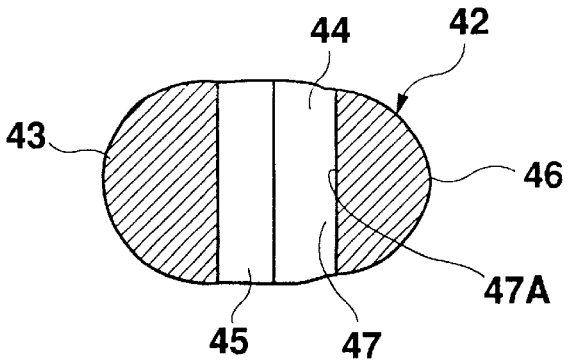
FIG. 6 is a sectional view taken along line III—III of FIG. 5.
Figure 7:
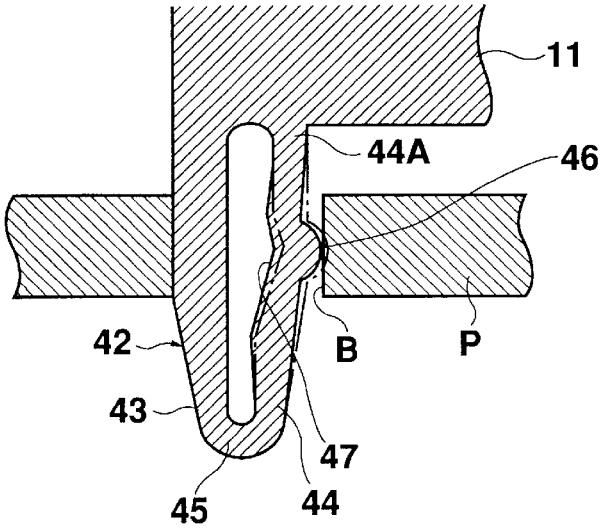
FIG. 7 is an explanatory view showing the leg of FIG. 5 is being inserted into a printed board.

In FIGS. 3 and 4, numeral 25 denotes a male contact to be housed in the housing 11. The male contact 25 is comprised of an upper half portion of a rectangular contact portion 26, a lower half portion of a thin-strip terminal portion 27, a joint portion 28 for joining a base portion upper end 26A of the contact portion 26 and a base portion 27A outside the contact portion 26, and a middle fixed portion 29 which is horizontally extended orthogonally from a base portion lower end 26B of the contact portion 26.

In FIG. 1, numeral 30 denotes the female connector which is constituted of a rectangular parallelepiped housing 31 engaged in the inner space portion 16 of the male connector and female contacts 32 which have tuning-fork shaped contact portions 33 to be opposed to the male contacts 25 of the male connector. Terminal portions 34 of the female contacts 32 are folded and bent outwardly and orthogonally from an upper end of the housing 31, and soldered to a printed circuit of a printed board.

Attachment of the male contacts 25 to the housing 11 will be described. The contact portions 26 of the male contacts 25 are positioned on a side face of the housing 11. The contact portions 26 are then pressed in the housing 11 from the openings in the front and rear side wall rims 15A. The base portions 27A of the terminal portions 27 are pressed in the lower holding grooves 23, while the terminal portions 27 are pressed in the terminal grooves 24.

Thereby, the base portion upper ends 26A are fixed in the upper holding grooves 18, the base portion lower ends 26B are fixed in the middle holding grooves 21, the middle fixed portions 29 are fixed in the side holding grooves 22, and the base portions 27A of the terminal portions 27 are fixed in the lower holding grooves 23. The terminal portions 27 extending downward from the terminal grooves 24 then protrude from an under face of the lower housing 13, while the joint portions 28 are exposed to the outside of the housing 11.

Subsequently, when the female connector 30 is engaged in the inner space portion 16 of the housing 11, the tuning-fork shaped contact portion 33 of the female contact 32 of the female connector 30 holds and abuts on the contact portion 26 of the male contact 25 from opposite sides. The male connector and the female connector are thus electrically connected.

In FIGS. 1 to 9, numeral 10 denotes a male connector. On opposite sides of an under end surface 11A of the housing 11, legs 42 described later are provided to be inserted and fixed in fixing holes B in the printed board P on which the male connector is mounted.

Numerals 43 and 44 denote leg components of the leg 42. The leg components 43 and 44 are spaced apart from each other at a predetermined interval, and extended from the under end surface 11A of the housing 11, respectively. Additionally, outer side faces of the leg components 43 and 44 are gradually tapered from central portions toward tip end portions. The tip end portions of the leg components 43 and 44 are integrally interconnected by a connection portion 45.

Numeral 46 denotes a substantially hemispheric projection which is provided on the outer side face of the leg component 44. The projection 46 protrudes from a substantially middle position of the leg component 44. A distance h from an upper base portion 46A of the projection 46 to the under end surface 11A of the housing 11 is set equal to or slightly longer than the plate thickness of the printed board P. Numeral 47 denotes a V-shaped hollow portion which is formed on an inner side face of the leg component 44. A top portion 47A of the hollow portion 47 is positioned on a substantially horizontal diametric line of the projection 46.

When the male connector 10 is mounted on the printed board P via the two legs 42 of the housing 11, the tip-end portions 45 of the legs 42 are pressed into the fitting holes B of the printed board P. The leg component 44 with the projection 46 formed thereon is then elastically deformed from a condition shown by a dashed line of FIG. 7 to the inside as shown by a solid line in the figure, while a base portion 44A and a vicinity of the tip-end portion 45 serve as supporting points.

In this case, the projection 46 is pressed strongest by a peripheral face of the fitting hole B of the printed board P.

Figure 8:
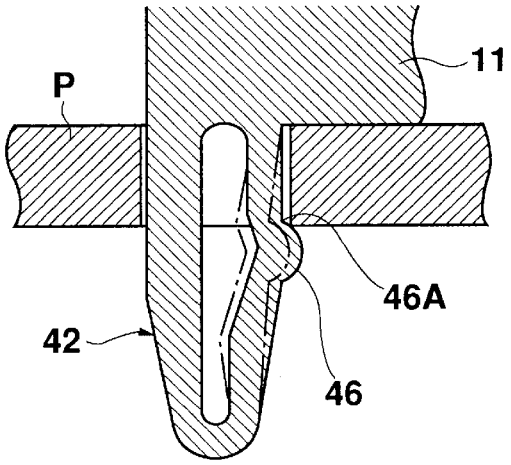
FIG. 8 is an explanatory view corresponding to FIG. 7 and showing completion of the leg insertion.

However, since the V-shaped hollow portion 47 is formed on the inner side face opposite to the projection 46 of the leg component 44, as shown by a dashed line of FIG. 8, a portion around the projection 46 of the leg component 44 is easily elastically deformed inward with a relatively weak force. The leg 42 is inserted into the fitting hole B of the printed board P in the condition shown by the solid line of FIG. 7. Then, when the projection 46 is passed through the fitting hole B of the printed board P, the leg components 43 and 44 return to a condition shown by a solid line of FIG. 8. Subsequently, when the upper base portions 46A of the projections 46 are engaged with the lower peripheral edges of the fitting holes B, the male connector 10 is fixed to the printed board P via the two legs 42 of the housing 11.

Figure 9:
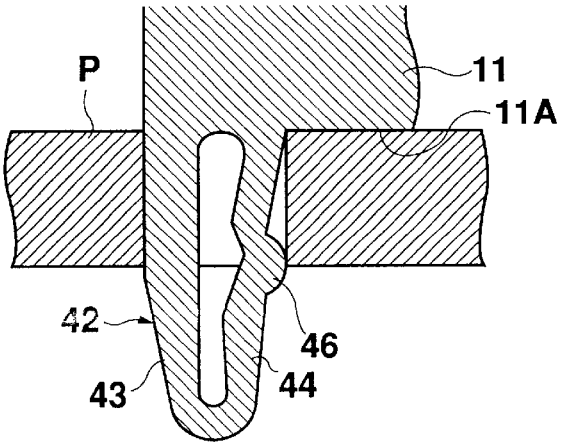
FIG. 9 is an explanatory view corresponding to FIG. 8 and showing another example of the completion of the leg insertion.
Figure 10:
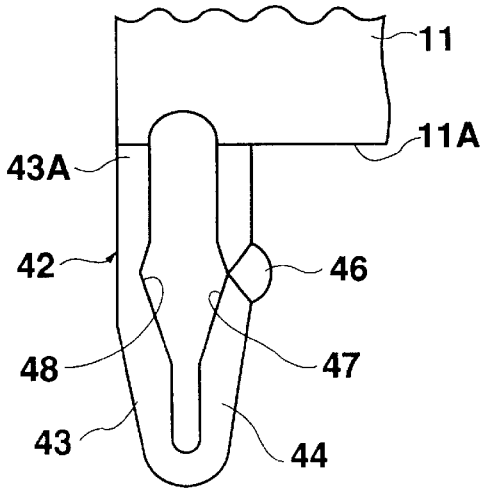
FIG. 10 is an enlarged front view of a leg according to another embodiment.

Here, the leg 42 constituted as aforementioned has a relatively softened spring property and is provided with a proper strength. Therefore, as shown in FIG. 9, even if there is a dispersion in dimensional precision, that is, even if the distance h from the upper base portion 46A of the projection 46 to the under end surface 11A of the housing 11 is shorter than the plate thickness of the printed board P, the projection 46 of the leg 42 is elastically held in the fitting hole B and firmly fixed therein.

FIGS. 10 to 13 show another embodiment which is different from the aforementioned embodiment in that an inner side face of the other leg component 43 of the leg 42 also has a V-shaped hollow portion 48 substantially the same as the hollow portion 47 opposite to the hollow portion 47 which is formed on the inner side face of the leg component 44.

Further, a base portion 43A of the leg component 43 is integrally formed with a side end portion of the housing 11. In some cases the leg component 43 has an excessively strong spring property. In this case, the base portion 43A is positioned above the under end surface 11A of the housing 11. Further, by making the base portion 43A thin, the leg component 43 can be easily deformed elastically.

Figure 11:
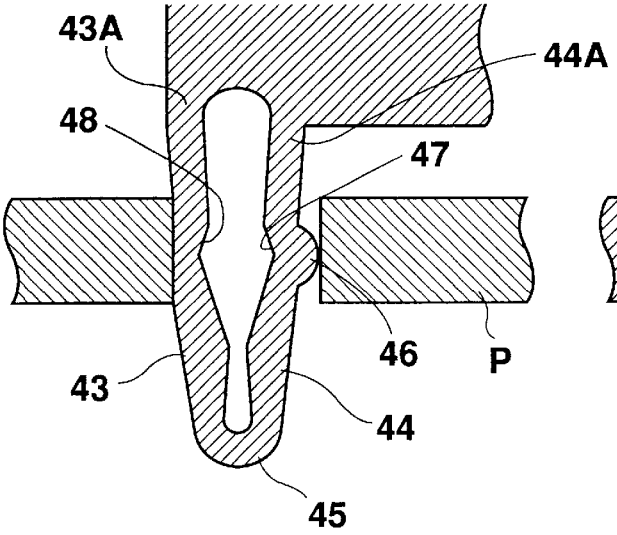
FIG. 11 is an explanatory view showing the leg of FIG. 10 being inserted into the printed board.

When the male connector is mounted on the printed board P via the two legs 42 formed on the housing 11, the tip-end portions 45 of the legs 42 are pressed into the fitting holes B of the printed board P. Then, as shown in FIG. 11, the leg components 43 and 44 are elastically deformed inward while the base portions 43A and 44A and the tip-end portion 45 serve as supporting points.

Figure 12:
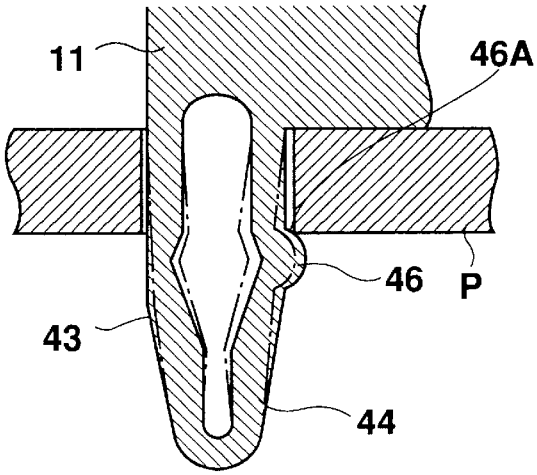
FIG. 12 is an explanatory view corresponding to FIG. 11 and showing completion of the leg insertion.
Figure 13:
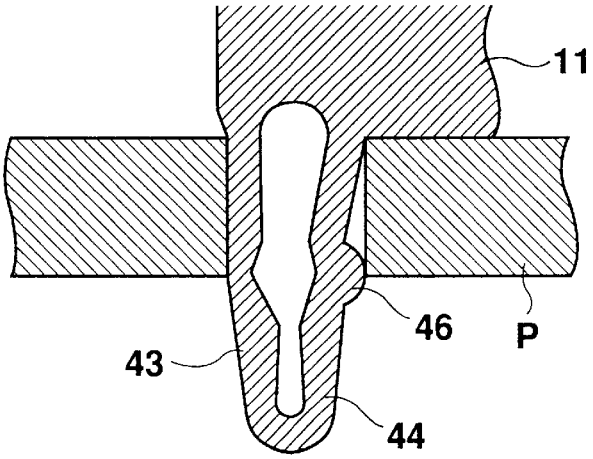
FIG. 13 is an explanatory view corresponding to FIG. 12 and showing another example of the completion of the leg insertion.

Subsequently, as shown in FIG. 12, when the projection 46 is passed through the fitting hole B, the leg components 43 and 44 return to a condition shown by a solid line in FIG. 12. Then, the upper base portion 46A of the projection 46 is engaged with the lower peripheral edge of the fitting hole B. Thereby, the male connector 10 is fixed via the two legs 42 formed on the housing 11 to the printed board P. Alternatively, as shown in FIG. 13, the leg 42 is fixed by the projection 46 in the fitting hole B.

A structure for fixing the base portion upper ends 26A in the upper holding grooves 18 will be described with reference to FIG. 14.

Figure 14:
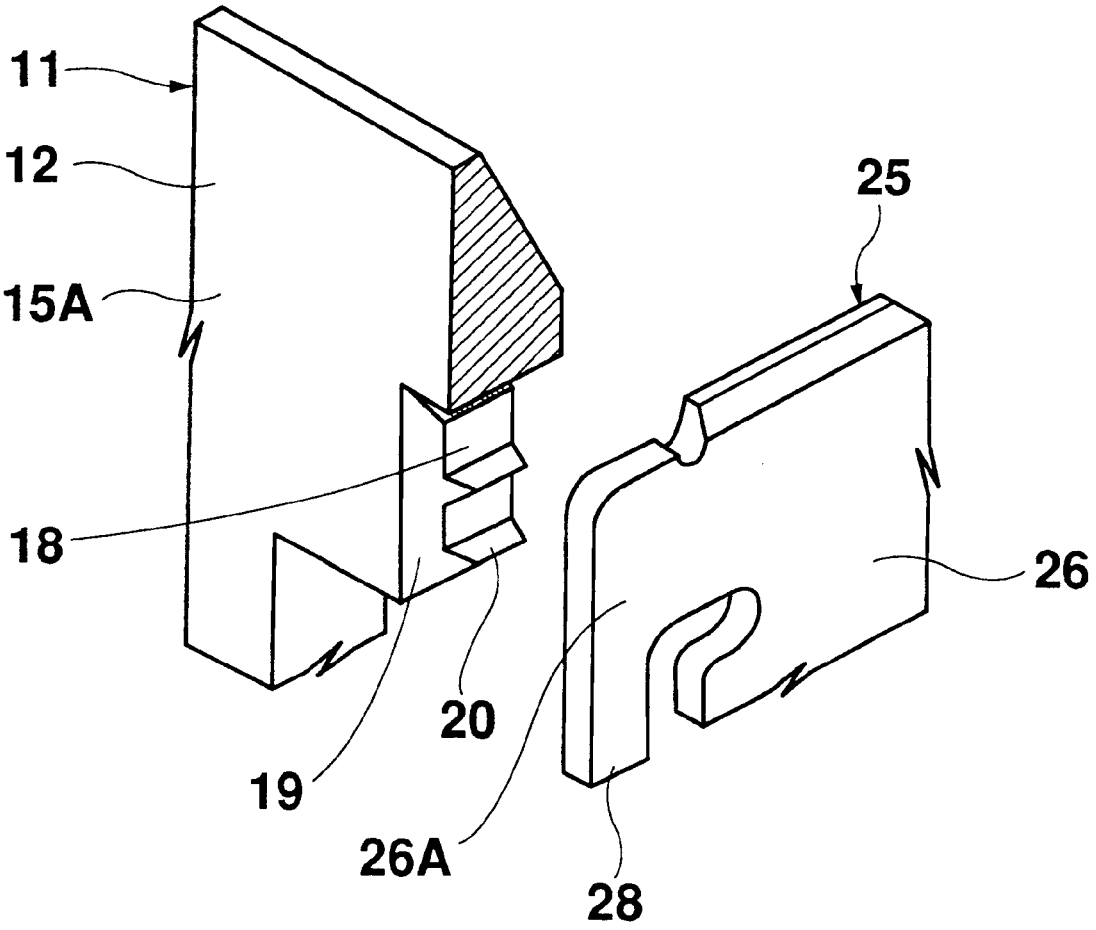
FIG. 14 is a main portion perspective view of a male connector showing a fixed structure of a base portion upper end of the male contact shown in FIG. 4.
Figure 15:
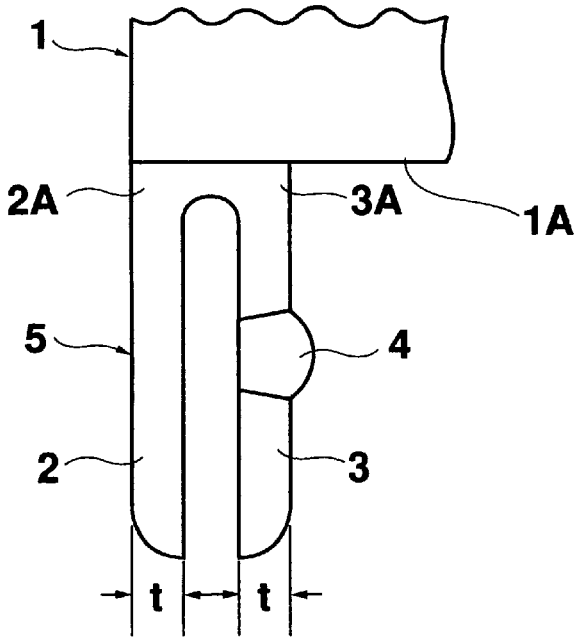
Fig. 15 PRIOR ART
FIG. 15 is an enlarged front view of a leg according to a prior art.
Figure 16:
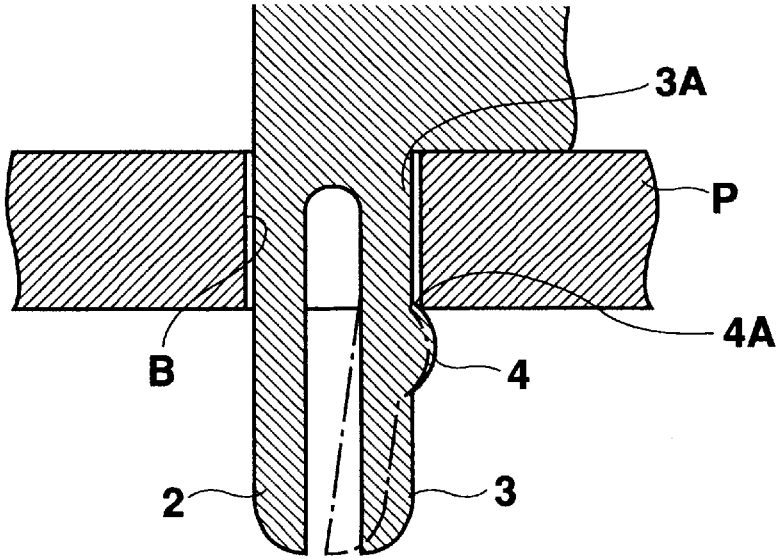
Fig. 16 PRIOR ART
FIG. 16 is an explanatory view showing insertion of the prior-art leg of FIG. 15 into the printed board.

In FIG. 14, numeral 18 denotes the rectangular upper holding groove which extends from the substantially central portion to the lower end of the front or rear side wall rim 15A. The portion of the upper holding groove 18 which opens to the outside of the side wall rim 15A has the plane-off corner 19 formed thereon. Additionally, at least one of the opposed faces of the upper holding groove 18 has several saw-teeth shaped projections 20 which are formed at vertical intervals and opposite to the other face.

Therefore, when the male contact 25 is attached to the housing 11, one side face of the base portion upper end 26A of the contact portion 26 is pressed by the projections 20 toward the other side face in the upper holding groove 18. The contact portion 26 is thus firmly held on a vertical line.

Consequently, the contact portions 33 of the female connector 30 engaged in the inner space portion 16 of the housing 11 are easily and smoothly engaged with the contact portions 26 of the male contacts 25. Thereby, an electric connection is made.

Also, when the male contact 25 is attached to the housing 11, one side face of the base portion upper end 26A of the contact portion 26 linearly abuts on the projections 20. Therefore, with less frictional resistance, the base portion upper end 26A can be easily inserted to the upper holding groove 18. Additionally, even after the insertion, since the pressing force of the projections 20 against the side face of the base portion upper end 26A becomes strong, the fixing is strengthened. The contact portions 26 can be vertically held constantly in predetermined positions.

What is claimed is:

1. A printed board connector which comprises:

a plurality of legs extending from an under face of a housing and comprised of a pair of right and left leg components, said leg components having tip-end portions integrally interconnected with each other, one of said leg components having an outer side surface with a projection, and also having an inner side surface with a notch whose maximum depth portion is positioned substantially on a center line of said projection, said plurality of legs being inserted in fitting holes of a printed board, and a plurality of contacts held in said housing and arranged between said legs.

2. The printed board connector according to claim 1 wherein a notch is also formed on an inner side surface of the other leg component opposite to the notch on the inner side surface of said one leg component of said leg.

3. The printed board connector according to claim 1 wherein base portions of said pair of right and left leg components are positioned above an under end surface of said housing.

4. The printed board connector according to claim 1, wherein said projection is a substantially hemispheric projection.

5. The printed board connector according claim 1, wherein the notch is substantially V-shaped.

6. The printed board connector according to claim 1 wherein said contact is a male contact having a contact portion that contacts a female contact, a portion of a base portion upper end of said contact portion being held in a holding groove which is formed in said housing.

7. The printed board connector according to claim 6, wherein said holding groove comprises two opposed faces, at least one projection being provided on at least one of the two opposed faces.

* * * * *